United States Patent [19]

Deutsch et al.

[11] Patent Number: 4,490,792

[45] Date of Patent: Dec. 25, 1984

[54] ACCELERATION FUEL ENRICHMENT SYSTEM

[75] Inventors: Robert W. Deutsch, Wheeling; Robert Martinsons, Chicago, both of Ill.

[73] Assignee: Motorola, Inc., Schaumburg, Ill.

[21] Appl. No.: 366,958

[22] Filed: Apr. 9, 1982

[51] Int. Cl.[3] ..... F02B 3/10; F02D 5/00; F02M 7/06

[52] U.S. Cl. ..... 364/431.07; 123/492; 123/493

[58] Field of Search ..... 123/486, 492, 493; 364/431.07

[56] References Cited

U.S. PATENT DOCUMENTS

| | | | |
|---|---|---|---|
| 3,759,231 | 9/1973 | Endo | 123/492 |
| 3,946,704 | 3/1976 | Monpetit | 123/492 |
| 4,159,697 | 7/1979 | Sweet | 123/492 |
| 4,176,625 | 12/1979 | Stauffer | 123/492 |
| 4,184,461 | 1/1980 | Leung | 123/492 |
| 4,244,023 | 1/1981 | Johnson | 364/431.07 |
| 4,245,312 | 1/1981 | De Vulpillieres | 364/431.07 |
| 4,245,605 | 1/1981 | Rice et al. | 123/492 |
| 4,255,789 | 3/1981 | Hartford et al. | 364/431.05 |
| 4,266,275 | 5/1981 | Marchak | 364/431.07 |
| 4,296,722 | 10/1981 | Furuhashi et al. | 123/492 |
| 4,314,538 | 2/1982 | Reddy | 123/485 |
| 4,334,513 | 6/1982 | Nakajima et al. | 123/492 X |
| 4,359,993 | 11/1982 | Carlson | 123/492 |
| 4,363,307 | 12/1982 | Amano et al. | 123/492 |

OTHER PUBLICATIONS

Grimm et al.: S.A.E. Paper 0148-7191/80/0225-053, pp. 1-16, entitled "An Micro-Computer Engine Control System", 1980.

Bowler: Automotive Engineering, vol. 88, No. 10, Oct. 1980, pp. 102-110, "Throttle Body Fuel Injection: An Integrated Engine Control System".

Hires et al.: S.A.E. Paper, 810495, Feb. 1981, "Engine Control Modeling SP-487", pp. 17-33, Transient Mixture Strength Excursions-An Investigation of Their Causes and the Development of a Constant Mixture Strength Fueling Strategy.

*Primary Examiner*—Felix D. Gruber

*Attorney, Agent, or Firm*—James W. Gillman; James S. Pristelski; Phillip H. Melamed

[57] ABSTRACT

An acceleration fuel enrichment system is disclosed in which if the rate of increase of throttle position is determined as exceeding a predetermined minimum threshold ($V_1$), asynchronous acceleration enrichment fuel control pulses are developed and effectively added to steady state synchronous base fuel control pulses provided by an engine control microprocessor. When the rate of throttle position increase falls below a preset level, the development of the asynchronous fuel control pulses is terminated and synchronous acceleration enrichment fuel pulses are provided which are effectively added to the base synchronous fuel control pulses. The durations of these synchronous acceleration enrichment pulses are initially fixed, but when a decrease in engine manifold pressure is sensed, these durations are determined in accordance with the rate of change of the magnitude of sensed engine manifold pressure. The development of all acceleration enrichment pulses, either synchronous or asynchronous, is terminated in response to either sensed engine manifold pressure decreasing over a time interval by more than a predetermined high threshold value ($V_3$) or by sensed engine manifold pressure decreasing over a time interval by less than a predetermined low threshold value ($V_2$) after a decrease of pressure over a time interval during the development of the acceleration enrichment pulses exceeded this low threshold value.

12 Claims, 7 Drawing Figures

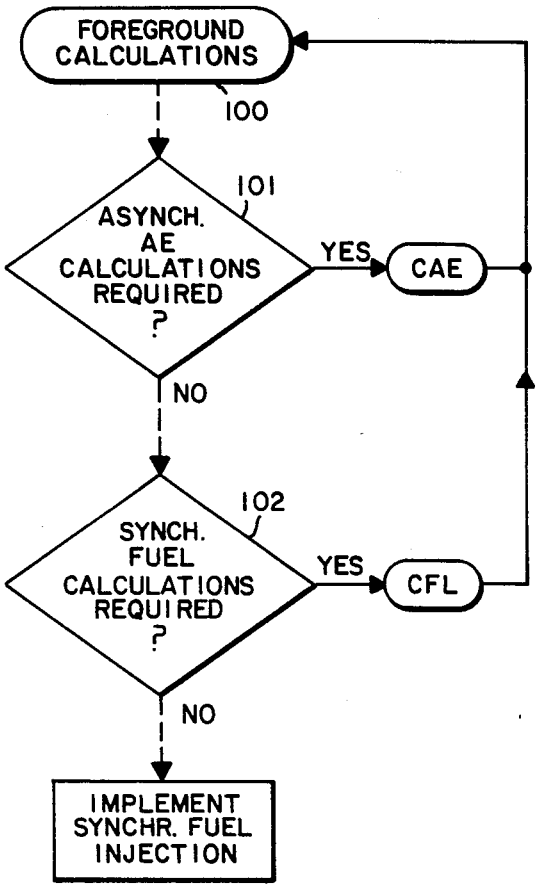
Fig. 4A
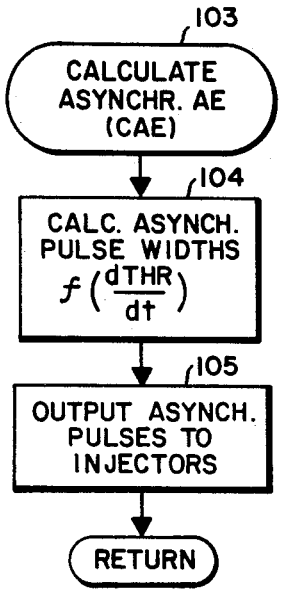
Fig. 4B
Fig. 4D
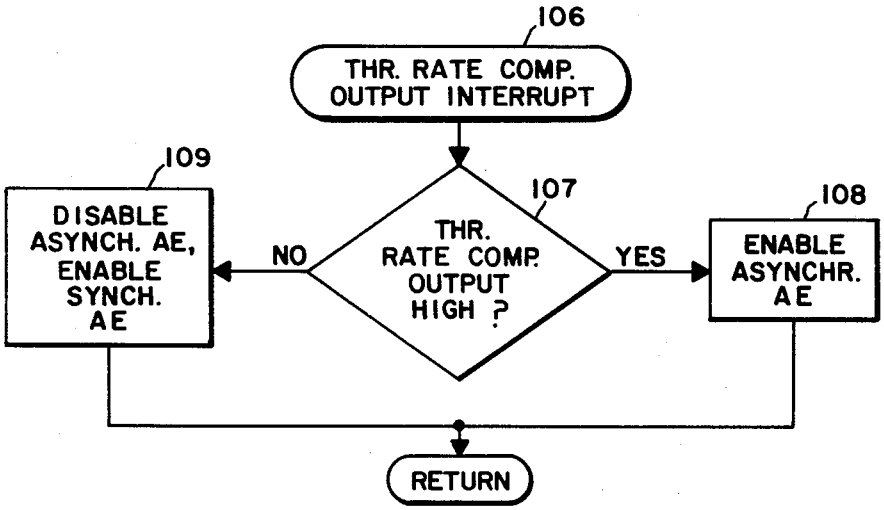

ACCELERATION FUEL ENRICHMENT SYSTEM

BACKGROUND OF THE INVENTION

The present invention generally relates to the field of acceleration fuel enrichment systems for an engine. More specifically, the present invention relates to the determination of the pulse width durations for acceleration enrichment pulses provided in such systems and the termination of the development of the acceleration enrichment pulses in such systems.

Many types of prior acceleration enrichment systems are known wherein during an increase in throttle position additional fuel is supplied to the engine whereas a substantial time after the transient increase in throttle position a steady state or base fuel control circuit provides engine fuel in accordance with the final or steady state throttle position. Typically the base fuel control circuit supplies base fuel control pulses which are synchronous with predetermined engine cylinder piston positions. In essence, acceleration enrichment systems are concerned with providing additional engine fuel during engine throttle position transients so as to improve the engine acceleration response by suppling the extra fuel needed during acceleration.

Some prior acceleration fuel enrichment systems respond to an engine acceleration transient by merely extending the fuel control pulse durations of the base engine synchronous fuel control pulses that are provided by the steady state fuel pulse control circuit. These acceleration enrichment systems typically do not perform in a satisfactory manner in that they do not react fast enough to an engine throttle position increase to provide additional fuel when it is needed by the engine. The result is hesitation of the engine during acceleration because of an excessively lean fuel mixture. Some other acceleration fuel enrichment systems attempted to solve this problem by developing asynchronous fuel control pulses which immediately added fuel to the engine upon the detection of a substantial increase in throttle position. Several of these type of acceleration fuel enrichment systems utilized engine control microprocessors to control not only the additional asynchronous acceleration enrichment pulses utilized for fuel control but also to calculate and provide the synchronous base fuel control pulses used for engine fuel control.

In the above described prior acceleration enrichment systems, after a lack of further increase in the throttle position has been determined either the acceleration enrichment is abruptly terminated or it is terminated acccording to a predetermined decay. Some additional acceleration enrichment after the throttle position has ceased to increase is typically provided to compensate for the fact that the engine may still have not arrived at a steady state condition. This explains why this additional enrichment is decayed as a function of time. The duration of the acceleration enrichment pulses provided during this decay of acceleration enrichment is typically predetermined based on engine operational parameters or their rate of change as determined during the increase of engine throttle position. In addition, the length of time during which acceleration enrichment decay pulses are provided is typically either a fixed time period, a time period determined in accordance with a predetermined number of engine revolutions, or a time period dependent upon engine operational parameters or their rates of change which exist during the increase of engine throttle position and engine manifold pressure produced in response to an increase in throttle position.

While some of the acceleration enrichment systems corresponding to the those described above perform fairly well, these systems do not optimize fuel delivery after the initial transient because they may provide either an excessive or insufficient amount of engine fuel. This is because the durations of the acceleration enrichment pulses provided after the initial increase in engine throttle position are typically determined by variations in throttle position and/or engine manifold pressure which occur prior to the acceleration enrichment decay characteristic. In other words, after the initial rising transient provided in response to throttle depression, the durations of acceleration enrichment pulses are determined in accordance with the variations of the engine operational parameters of throttle position and engine manifold pressure which preceded the acceleration enrichment decay characteristic. Thus the acceleration enrichment decay characteristic is typically not a function of current engine conditions and therefore this decay characteristic does not properly reflect the actual amount of acceleration enrichment which is required by the engine after the initial throttle position transient. In addition, the fact that some prior acceleration enrichment systems terminate the acceleration enrichment decay after a predetermined time interval based on either the passage of a fixed period of time or the attainment of a predetermined number of engine revolutions, also makes the time during which acceleration enrichment decay occurs nonrepresentative of the primary engine operational parameter of engine manifold presure which exists after the initial acceleration transient which was caused by depression of the engine throttle.

SUMMARY OF THE INVENTION

An object of the present invention is to provide an improved acceleration fuel enrichment system in which improved engine operability is provided by monitoring the rate of change in at least one engine operational parameter which exists after an initial throttle acceleration transient and controlling the amount of acceleration enrichment in accordance therewith.

In one embodiment of the present invention an acceleration fuel enrichment system for an engine is provided. The enrichment system comprises: sensor means for providing electrical signals representative of a number of sensed engine operational parameters including engine crankshaft rotational position, engine throttle position and engine manifold pressure; steady state fuel pulse control means coupled to said sensor means for providing base fuel injection pulses synchronized with engine cylinder piston position, the duration of these base fuel injection pulses being determined in accordance with at least one of the sensed engine operational parameters; wherein the improvement comprises an improved acceleration enrichment means coupled to said sensor means, comprising the combination of; means for developing at least one initial acceleration enrichment pulse, in addition to said synchronous base fuel injection pulses, in response to an increase in at least any selected one of the sensed engine parameters of engine throttle position and engine manifold pressure causing its rate of change to exceed a predetermined minimum threshold value, means for terminating the development of said initial enrichment pulses, means for effectively providing, at least after termination of said initial enrichment pulses, additional fuel enrichment pulses, said additional pulses having durations determined in accordance with the rate of change of sensed engine manifold pressure which exists after said selected engine parameter has ceased to increase and after a subsequent decrease in engine manifold pressure has been sensed, means for terminating the providing of said additional fuel enrichment pulses, and means for effectively adding said initial and additional fuel enrichment pulses to said synchronous base fuel pulses, thereby providing a composite engine fuel control signal.

Essentially, the present invention as stated above provides for controlling the duration of acceleration enrichment pulses in accordance with the rate of change of sensed engine manifold pressure which exists after the initial engine acceleration transient and after an initial decrease in sensed manifold pressure has been determined. This feature enables the present invention to provide engine fuel more directly in accordance with the actual fuel requirements of the engine since the engine fuel, even during the decaying portion of the acceleration enrichment mode, is now a function of engine manifold pressure which is an engine operational parameter directly related to the fuel requirements of the engine.

More specifically, the present invention contemplates initially providing asynchronous acceleration enrichment fuel pulses which are added to the synchronous engine base fuel pulses wherein after the asynchronous fuel injection pulses, additional synchronous acceleration. enrichment pulses are provided having their durations controlled in accordance with the sensed engine manifold pressure which exists during the acceleration enrichment decay portion.

Two significant aspects of the present invention are that the acceleration enrichment transient mode is terminated in response to either the sensing of a large negative rate of change in sensed engine manifold or the sensing, after the implementation of the acceleration enrichment transient decay mode, a lack of further decrease of the sensed engine manifold pressure after an initial rate of decrease of engine manifold pressure has occurred. The present invention recognizes that a large negative rate of change in sensed engine manifold pressure will occur in response to an abrupt release of the engine throttle thus signifying the end of the acceleration enrichment mode of operation. In addition, the present invention recognizes that a gradual decrease in engine manifold pressure may occur, subsequent to the initial increase in pressure provided in response to an increase in throttle position, and that when this decrease in manifold pressure ceases, this is indicative of a steady state condition of the engine thereby signifying the lack of need for additional acceleration enrichment fuel control pulses.

Because the enrichment control system of the present invention monitors the change in engine manifold pressure that exists after the initial increase in throttle position occurs in an acceleration transient, the fuel control system of the present invention is more adaptive to actual engine fuel needs and therefore offers improved drivability and fuel economy over prior acceleration enrichment systems.

BRIEF DESCRIPTION OF THE DRAWINGS

For a more complete understanding of the present invention reference should be made to the drawings, in which.

DESCRIPTION OF THE PREFERRED EMBODIMENTS

Figure 1:
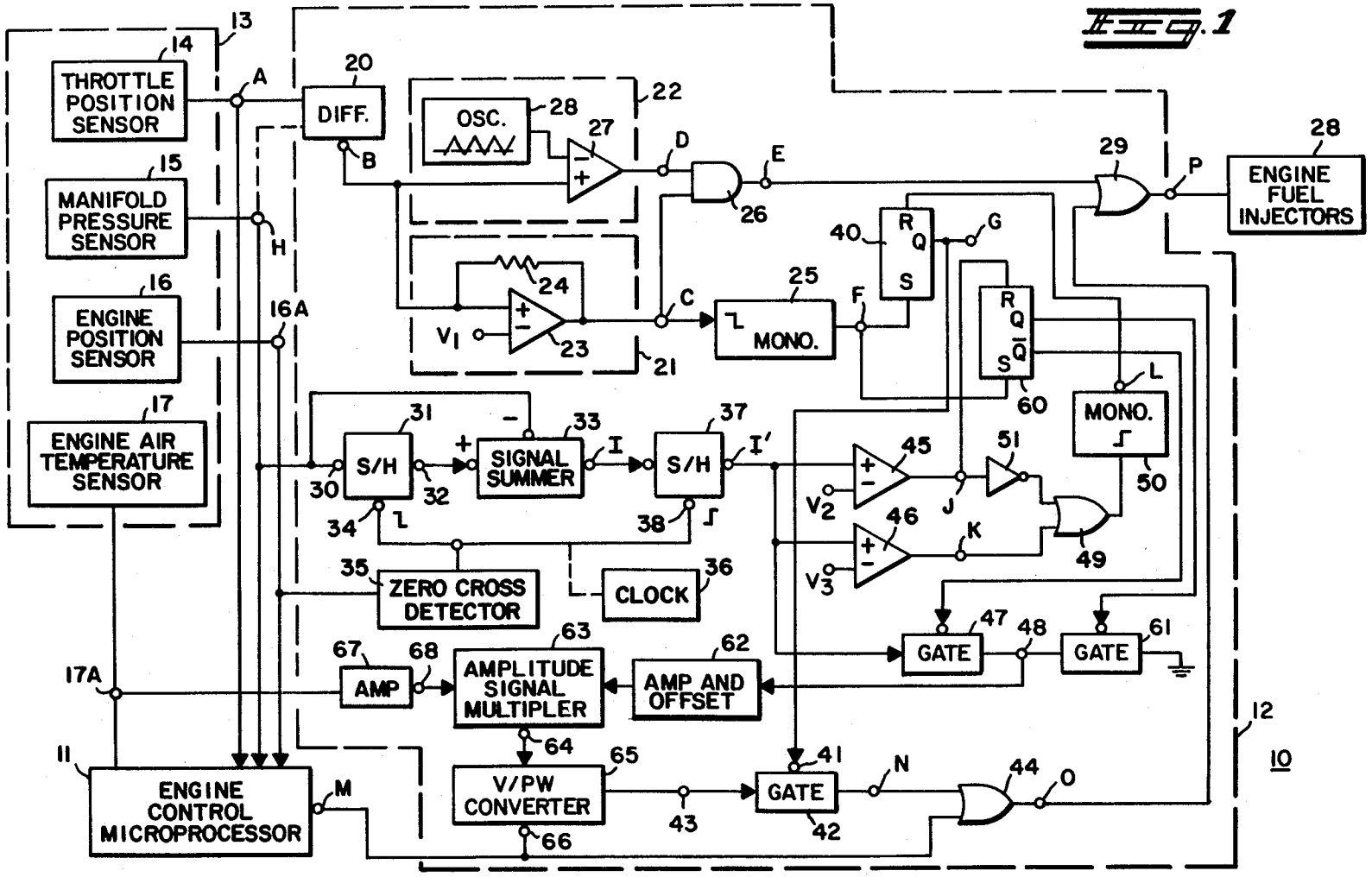
FIG. 1 is a schematic diagram of an acceleration fuel enrichment system embodying the present invention.

FIG. 1 illustrates an acceleration fuel enrichment system 10 in which engine synchronous steady state base fuel control pulses are provided by an engine control microprocessor 11 at a terminal M wherein these base fuel control pulses are essentially modified by an improved acceleration enrichment circuit 12 (shown dashed) so as to ensure a rapid response of the fuel control system to engine acceleration while also ensuring proper control of the engine fuel in accordance with engine parameters during and after the initial acceleration transient which is initiated in response to a depression of the engine throttle. The system 10 shown in FIG. 1 represents a hardware embodiment of the present invention for controlling acceleration fuel enrichment. Preferably, a microprocessor can be programmed to implement the acceleration fuel enrichment functions of the present invention, and the flowcharts shown in FIG. 4 generally illustrate how to program a microprocessor to implement these functions.

The acceleration fuel enrichment system 10 shown in FIG. 1 includes sensor apparatus 13 (shown dashed) which includes a number of individual engine operational parameter sensors that provide corresponding representative electrical output signals. The sensor apparatus 13 includes a throttle position sensor 14 which provides an analog electrical signal at a terminal A which signal is representative of engine throttle position. A manifold air pressure (MAP) sensor 15 is also included in the sensor apparatus 13 and provides an analog electrical output signal at a terminal H that is representative of the sensed engine manifold pressure. An engine position sensor 16 is also provided in the sensor apparatus 13 and essentially provides a series of pulses wherein the occurrence of each pulse is representative of the occurrence of a predetermined engine crankshaft rotational position. The output of the engine position sensor 16 is provided at a terminal 16*a*. An engine air temperature sensor 17 is located within the sensor apparatus 13 and provides an electrical analog signal at a terminal 17*a* wherein this signal is representative of engine air temperature.

Sensors corresponding to the sensors 14–17 are well known and are commonly available. Typically the throttle position sensor 14 will comprise a resistive potentiometer with the wiper arm of potentiometer providing a variable magnitude analog voltage at the terminal A related to the position of the engine throttle. The manifold pressure sensor 15 typically comprises a capacitive or resistive pressure sensor also providing a variable magnitude analog signal at the terminal H. The engine position sensor 16 can comprise either a Hall effect sensor or a reluctance sensor either of which will sense projections rotated synchronously with the engine crankshaft and thereby provide output pulses representative of the occurrence of predetermined rotational positions of the crankshaft. The engine air temperature sensor 17 can comprise a thermistor or other such apparatus which provides a variable magnitude analog signal at the terminal 17A representative of air temperature.

The terminals A, H, 16A and 17A are directly coupled as inputs to the engine control microprocessor 11, which receives these signals and, in accordance with at least one of these sensed operational parameters, determines the duration of steady state base fuel control pulses provided at the terminal M wherein these base pulses are provided in synchronization with predetermined piston positions in the engine cylinders. The use of programmed engine control microprocessors such as the processor 11 to provide steady state base fuel control pulses as an output is known and described in many prior publications. In addition, hardware circuits which receive a number of engine operational parameter signals as inputs and produce steady state base fuel control pulses as an output are also known. Since both hardware and microprocessor steady state base fuel control circuits are known, details regarding the construction and the base fuel control programming of the microprocessor 11 will not be discussed herein, especially since the essence of the present invention resides in the acceleration enrichment circuit 12, not the base fuel control function of the microprocessor 11. The circuit 12 is utilized to effectively modify the base fuel control pulses provided at the terminal M and provide a modified fuel control signal.

It should be noted that the term "steady state" is used herein to designate base enoine fuel control pulses that are provided in response to sensed engine operational parameters during non engine acceleration or deceleration conditions. Prior art publications have used similar terminology in this respect and have also utilized the terminology "acceleration enrichment" to refer to the additional engine fuel which is required during an accelerating engine condition. The term "acceleration transient" as utilized herein refers to changes in the engine operational parameters of throttle position and manifold pressure which are produced in response to depression of the engine throttle resulting in engine acceleration. The adjective "initial" when applied to "acceleration transient" refers to the portion of the acceleration transient that commences at an increase in throttle position which initiates engine acceleration and that terminates in response to the lack of further increase of engine throttle position. The term "decay" is used as an adjective for the portion of the acceleration transient which follows the initial portion of the acceleration transient and during which additional fuel enrichment pulses are still effectively added to the base fuel control pulses.

Figure 2:
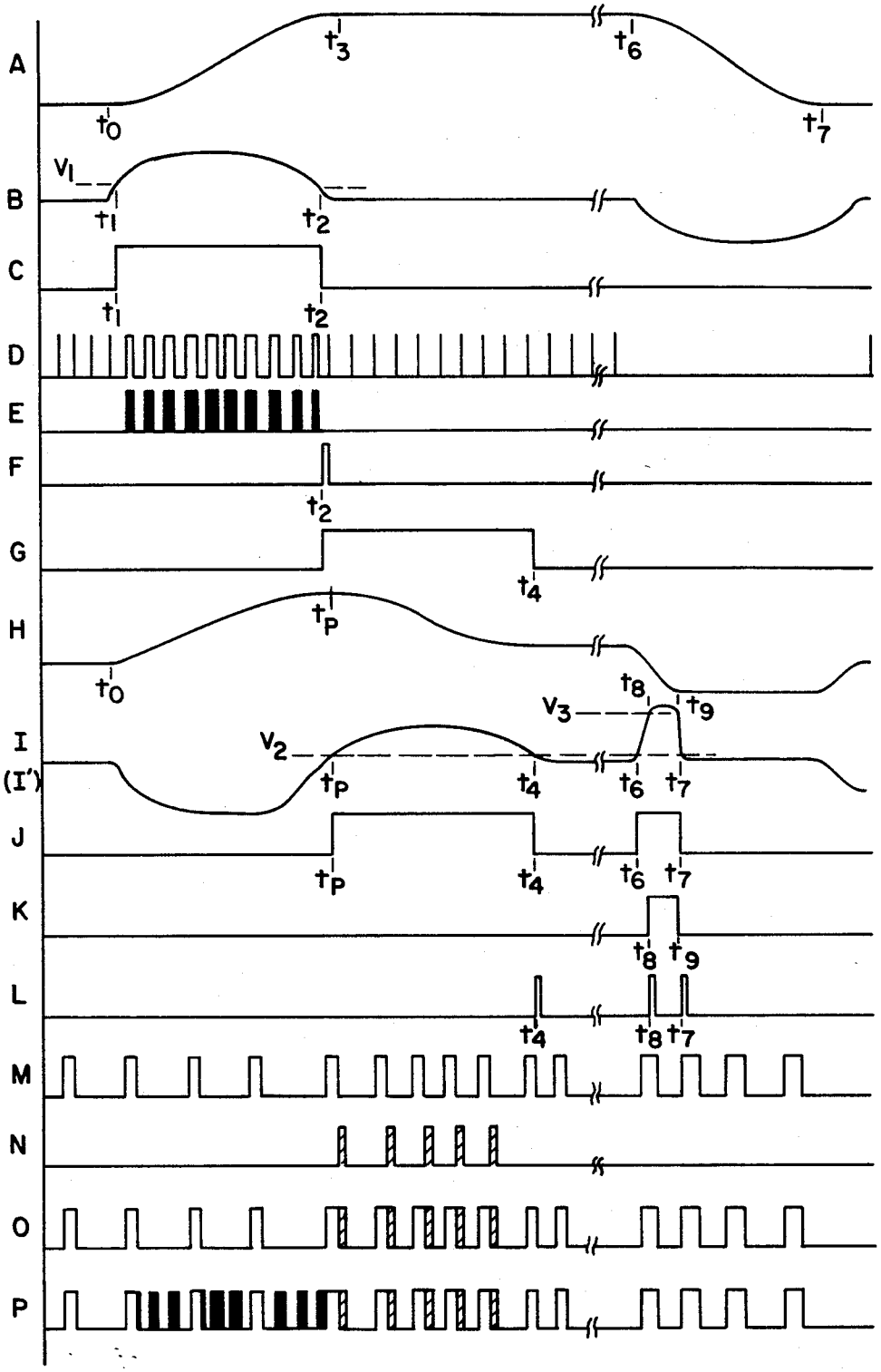
FIG. 2 is a series of graphs A through P representative of engine signals provided by the system shown in FIG. 1 in response to one set of engine operating conditions.
Figure 3:
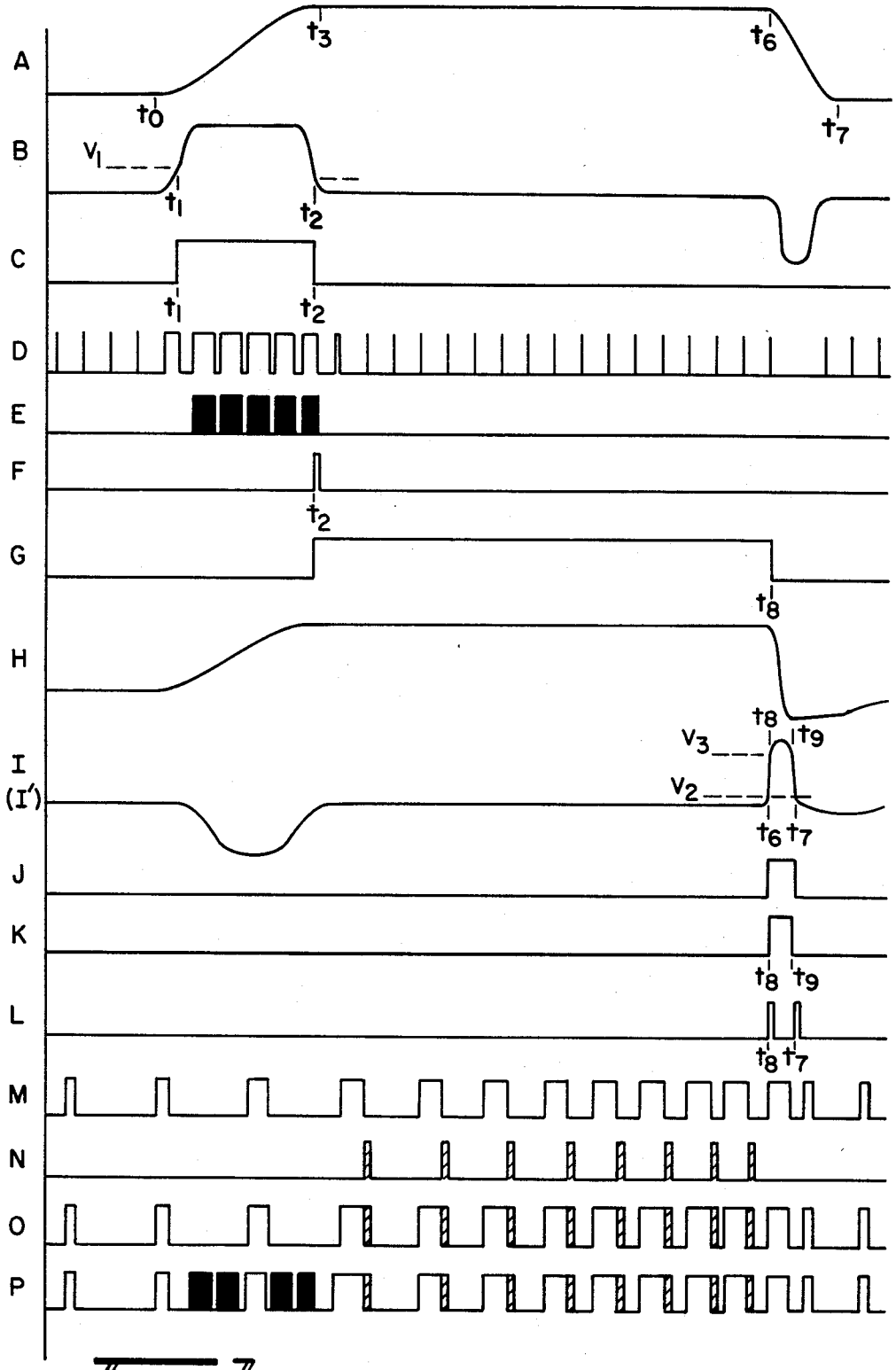
FIG. 3 is a series of graphs A through P representative of signals provided by the system shown in FIG. 1 in response to a different set of engine operating conditions.

The present invention can be better understood by considering the circuitry in FIG. 1 in conjunction with the signal waveforms illustrated in FIGS. 2 and 3 wherein the signals at terminals A through P in FIG. 1 are represented by the waveforms in graphs A through P in FIGS. 2 and 3. The letter designations A through P are used to identify the signals provided by the system 10 and the respective terminals in FIG. 1 at which those signals are provided. The signal waveforms in each of the FIGS. 2 and 3 have a vertical axis representative of magnitude and a horizontal axis representative of time, with all of the waveforms in FIG. 2 having the same time scale and all of the waveforms in FIG. 3 having the same time scale. The signals I and I′ are substantially identical so only the signal I′ is illustrated in FIGS. 2 and 3.

As was previously noted, the signal at the terminal A is representative of engine throttle position whereas the signal at the terminal H is representative of sensed engine manifold pressure. These signals are illustrated by the graphs in FIG. 2 for an initial acceleration transient which occurs between the times $t_0$ and $t_3$ wherein this corresponds to an increase of throttle position between some nominal throttle position and a final throttle position which is less than wide open throttle. Under these conditions, the signal H in FIG. 2 illustrates that at the approximate time $t_3$, a peak engine manifold pressure is reached wherein subsequently the manifold pressure decreases gradually to a lesser value at substantially the time $t_4$. This lesser value is maintained until the onset of engine deceleration which occurs at the time $t_6$ due to a gradual release of the engine throttle which is completed at a subsequent time $t_7$. During the deceleration transient between $t_6$ and $t_7$, the engine manifold pressure decreases again as shown by the signal H in FIG. 2.

FIG. 3 essentially illustrates the same signals as shown in FIG. 2 except that FIG. 3 illustrates these signals when the throttle position is incremented between the times $t_0$ and $t_3$ to a wide open throttle position that is maintained until the time $t_6$. The signal H in FIG. 3 illustrates that under these conditions the engine manifold pressure will essentially remain constant between the times $t_3$ and $t_6$.

As stated previously, the essence of the present invention resides in monitoring engine operational parameters, especially the rate of change of engine manifold pressure, after the initial acceleration transient between the times $t_0$ and $t_3$. The present invention then contemplates modifying the acceleration enrichment fuel control in accordance with engine operational parameters which exists subsequent to the time $t_3$. Prior circuits try to estimate acceleration enrichment requirements after the time $t_3$ based on the magnitudes of engine operational parameters that exist between the times $t_0$ to $t_3$. The present invention does not rely on these pre-existing engine operational parameters since it has been found that they do not accurately reflect the actual fuel needs of the engine during the times between $t_3$ and $t_6$. To correct this deficiency, the present invention contemplates utilization of engine operational parameters subsequent to the time $t_3$ to determine the amount of additional acceleration enrichment to be provided and to determine when acceleration enrichment should be terminated. This is accomplished by the acceleration enrichment circuit 12 shown in FIG. 1 in the following manner.

The analog throttle position signal A is provided as an input to a differentiator circuit 20 which provides an output at a terminal B representative of the rate of change (the derivative) of the signal at the terminal A. The throttle position rate of change signal at the terminal B is coupled as an input to a comparator circuit 21 (shown dashed) and a pulse width modulator circuit 22 (shown dashed).

The comparator circuit 21 includes a voltage comparator 23 having its negative input terminal connected to a minimum threshold reference voltage $V_1$ and its positive input terminal connected to the terminal B and connected to the output of the comparator 23 through a feedback resistor 24 which provides a slight amount of hysteresis for the comparator 23. The output of the comparator 23 is provided at a terminal C which is coupled as an input to a falling edge triggerable monostable 25 and an AND gate 26. The function of the comparator circuit 21 is to compare the rate of change signal B at the terminal B with the reference threshold $V_1$ and provide an output pulse when the rate of change signal B exceeds threshold $V_1$. The signal at the terminal C is therefore a throttle position rate comparator output signal. This is illustrated in FIGS. 2 and 3 by the signal C which commences at the time $t_1$ to provide a high logic state that terminates at the time $t_2$ slightly before the time $t_3$. The resistor 24 is utilized to provide a slight amount of hysteresis and this explains why the turn on trigger level for the comparator 21 is slightly higher at the time $t_1$ than the turn off level at the time $t_2$ which corresponds to when rate of change signal B falls below the turn off threshold level of the circuit 21.

The present invention contemplates utilizing the throttle position rate comparator output signal at the terminal C as an indication of when asynchronous enrichment pulses should be provided. The negative transition of the signal C at time $t_2$ is utilized by the monostable 25 to provide a trigger pulse at a terminal F at the time $t_2$ wherein the signal F is utilized to enable the production of synchronous acceleration enrichment pulses after the throttle position signal A has ceased to increase.

The pulse width modulator circuit 22 includes a voltage comparator 27 having its positive input terminal directly connected to the terminal B, its negative input terminal connected to the output of a triangle wave oscillator 28, and its output connected to a terminal D. The output of the triangle wave oscillator 28 is contemplated as having minimum peaks which are just below ground voltage. With this configuration the pulse width modulator circuit 22 will essentially provide only short duration impulses at the terminal D unless the throttle rate of change signal B indicates a substantial increase is occurring in the engine throttle signal at the terminal A. In this event substantial duration pulses will be periodically provided at the terminal D which is coupled as an input to the AND gate 26 that provides an output to a terminal E.

With the configuration described above, it is apparent that the signal at the terminal E represents an engine asynchronous burst of pulses having durations determined by the magnitude of the rate change signal B wherein only these pulses which occur between the times $t_1$ and $t_2$ are allowed to pass through the AND gate 26. The signal at the terminal E represents initial asynchronous acceleration enrichment pulses which are to be added to the synchronous steady state base fuel pulses provided by the microprocessor 11 so as to provide a composite engine fuel control signal at a terminal P that is coupled as an input to engine fuel injectors 28 shown in FIG. 1. Fuel injectors such as the injectors 28 are well known and commonly available.

It should be noted that alternatively, the differentiator circuit 20 can receive the engine manifold pressure sensor signal H as an input rather than the throttle position signal A. This is because during the initial acceleration enrichment transient between the times $t_0$ and $t_3$, the throttle position signal A and the engine manifold pressure signal H vary similarly. In any event, the purpose of the circuit elements 20 through 27 is to provide an asynchronous burst of acceleration enrichment pulses at the terminal E during the initial acceleration enrichment transient portion. This will insure a rapid increase in engine fuel in response to engine acceleration caused by depression of the throttle. It should be noted that the signals A through F shown in FIGS. 2 and 3 are essentially identical since the present invention contemplates responding similarly with regard to the development of the asynchronous acceleration enrichment pulses initially produced, regardless of any subsequent decay of engine manifold pressure which may exist subsequent to the time $t_3$. It should be noted that when the signal C terminates at the time $t_2$ this terminates the asynchronous burst of pulses by preventing the AND gate 26 from passing any further pulses to the terminal E.

In FIG. 1, the terminal E is coupled as an input to an OR gate 29 whose output is directly coupled to the composite fuel control terminal P. A terminal O is also connected as an input to the OR gate 29 wherein it is contemplated that synchronous fuel control pulses will be provided at the terminal O which are to be combined with the asynchronous acceleration enrichment pulses at the terminal E by the OR gate 29 which effectively forms a combiner circuit for these signals to produce a composite fuel control signal at the terminal P.

As was previously noted, the essence of the present invention resides in monitoring engine operational parameters which exist subsequent to the time $t_3$. This is accomplished by the acceleration enrichment circuit 12 in FIG. 1 in the following manner.

The engine manifold pressure signal at the terminal H is coupled to an input terminal 30 of a sample and hold circuit 31 whose output terminal 32 is connected to a positive input terminal of a signal summer 33. A negative input terminal of the signal summer 33 is directly connected to the terminal H, and the signal summer provides an output at a terminal I. A control terminal 34 of the sample and hold circuit 34 receives time event related pulses from either the output of a zero cross detector 35 having its input connected to the engine position sensor terminal 16A or alternatively from a clock oscillator 36.

Essentially negative signal transitions at the terminal 34 result in actuating the sample and hold circuit 31 such that the magnitude of the signal at the terminal 30 will be sampled and held at the terminal 32 until the next negative signal transition at the terminal 34. This will result in the signal at the terminal I being representative of the negative rate of change of the signal at the terminal H since essentially the time between successive negative transitions of the time event signal at the terminal 34 define a time interval and the signal summer 33 effectively subtracts the present engine manifold pressure value at H from the previous held engine manifold pressure value at 32. The terminal I is coupled as an input to a sample and hold circuit 37 which provides an output at a terminal I'. The signal at I' is essentially the same as the signal at the terminal I, but the signal I' is held at discrete signal magnitudes until positive signal transitions are received at a control terminal 38 of the sample and hold circuit 37. At the time of these positive signal transitions the magnitude of the signal I is sampled by the circuit 37 and then held at the terminal I' until the next positive signal transition. The control terminals 34 and 38 of the sample and hold circuits 31 and 37 are coupled together so that the same time event signal triggers both of these circuits on opposite signal transitions. This results in the signal at the terminal I being representative of the negative rate of change of the engine manifold pressure. The signal at the terminal I' will essentially correspond to the signal I and will be utilized, after the time $t_3$, to determine when acceleration enrichment should be terminated and also to determine the magnitude of synchronous acceleration enrichment pulses which exist after the time $t_3$.

It should be noted that zero cross detector 35 is utilized to actuate the sample and hold circuits 31 and 37 in accordance with the predetemined rotational position of the engine. However, while this configuration is preferred, actually this configuration merely provides predetermined time event signals to trigger the sample and hold circuits 31 and 37 and this function could also be provided by the clock 36 which would provide pulses that were not necessarily synchronized to engine operation. The function of the zero cross detector 35 is to merely process the engine position sensor signal at the terminal 16A and insure that rising and falling transition signals are provided to the sample and hold circuits in response to the signal of the terminal 16A. Such a zero cross detector may not be needed if Hall effects sensors are utilized for the sensor 16, but is preferably utilized if reluctance sensors are utilized for the sensor 16.

As was noted previously, the signal at terminal F is utilized to effectively enable providing synchronous acceleration enrichment pulses after the time $t_3$. This is accomplished in the following manner.

The terminal F is directly coupled to the set input S of a flip-flop circuit 40 which has its output Q connected to a terminal G which is directly connected to a control terminal 41 of a series pass gate 42. A reset terminal R of the flip-flop 40 is directly connected to a terminal L. It is contemplated that as long as the flip-flop circuit 40 has been set by the signal at the terminal F, and has not been reset by a signal at the terminal L, a high logic signal will exist at the terminal G commencing at the time $t_2$ and this will allow the gate 42 to pass pulses provided at a terminal 43 through the gate to a terminal N wherein the signal at the terminal N represents additional synchronous acceleration enrichment pulses. In the absence of a high logic signal at the terminal G, the gate 42 will be opened preventing any additional acceleration enrichment synchronous pulses from being provided at the terminal N. The terminal N is connected as an input to an OR gate 44 whose output is directly connected to the terminal O. The terminal M is also connected as an input to the OR gate 44 whose function is to effectively combine the steady state base fuel control pulses provided at the terminal M with the additional synchronous acceleration enrichment pulses provided at the terminal N and to supply the combination of these synchronous fuel pulses to the terminal O for combination with the asynchronous pulses at the terminal E by the OR gate 29.

The manner in which the additional synchronous acceleration enrichment pulses enabled by the signal G are terminated in accordance with the negative rate of change signal I' of manifold pressure will now be discussed.

The terminal I' is directly connected to the positive input terminals of a low threshold comparator 45 and a high threshold comparator 46 as well as being coupled as an input to a series gate 47 that has its output connected to a terminal 48. A negative input terminal of the low threshold comparator 45 is connected to a reference voltage $V_2$ which represents a low threshold value for the comparator 45 and the negative rate of change of manifold pressure signal I'. A negative input terminal of the high threshold comparator 46 is coupled to a fixed high reference voltage $V_3$ which provides a predetermined high threshold value for the comparator 46. It should be noted that the voltage $V_3$ is substantially greater than the voltage $V_2$ which is slightly above ground potential. The output of the comparator 46 is connected to a terminal K which provides an input to an OR gate 49 whose output is coupled as an input to a positive transition triggerable monostable circuit 50 which has its output directly connected to the terminal L.

The function of the high threshold comparator 46 is to provide for terminating the additional synchronous acceleration enrichment fuel pulses in response to sensing a decrease of engine manifold pressure over a predetermined time interval wherein this decrease is more than the predetermined high threshold value represented by the voltage $V_3$. In other words, when the signal at the terminal I', which essentially corresponds to the signal of the terminal I, exceeds the threshold reference voltage $V_3$, this indicates an extremely large negative change in engine manifold pressure over a predetermined time interval. This occurs in response to the release of the engine throttle and is indicative of an abrupt engine deceleration. The present invention thus provides for terminating all acceleration enrichment when, by monitoring the rate of change of engine manifold pressure, it has become clear that additional acceleratcr enrichment fuel is not required since the engine is decelerating. The signal L in FIG. 3 illustrates how this termination of the additional snychronous acceleration enrichment pulses will be accomplished at a time $t_8$ due to a release of the engine throttle causing a large negative rate of change in manifold pressure over a time interval, wherein it should be remembered that the signal I (which is essentially identical to I') in FIGS. 2 and 3 is representative of the negative rate of change of engine manifold pressure.

The low threshold pressure rate of change comparator 45 is utilized to terminate additional synchronous acceleration enrichment pulses after the time $t_3$ in response to determining that after the time $t_3$ the engine manifold pressure first decreased over a predetermined time interval by more than a low threshold value (corresponding to the voltage $V_2$) and then was sensed as decreasing over a time interval by less than this low threshold value corresponding to the voltage $V_2$. The signals H, I, J and L in FIG. 2 best illustrate this feature which results from the output of the comparator 45 being coupled to a terminal J that is coupled through a signal inverter 51 as an input to the OR gate 49.

Referring to FIG. 2, it can be seen that after engine manifold pressure has reached a peak at approximately $t_3$, the engine manifold pressure signal H will gradually decrease until approximately time $t_4$ at which time a relatively constant level of engine manifold pressure exists until engine deceleration commences at approximately the time $t_6$. As was previously noted, the waveform I in FIG. 2 represents the negative rate of change of the engine manifold pressure signal H. At the time $t_p$, which is a little after the time $t_3$, the output of the low threshold comparator 45 will go high because the initial rate of decrease of the engine manifold pressure goes beyond the low threshold limit corresponding to the voltage $V_2$. This creates a positive transition at the time $t_p$ at the terminal J. Subsequently, at the time $t_4$ the rate of decrease of engine manifold pressure has now become less than the low threshold value corresponding to the voltage $V_2$. This results in a negative transition of the signal at the terminal J which, due to the inverter 51, results in triggering the monostable 50 and providing a reset pulse in the signal L at the time $t_4$. This reset pulse then results in resetting the flip-flop 40 which in turn disables the gate 42 thereby terminating the providing of any additional synchronous fuel enrichment pulses by the present circuit.

Due to the above described operation of the comparators 45, 46 the present invention has provided for terminating additional synchronous acceleration enrichment fuel control pulses in response to sensing the rate of decrease of engine manifold pressure subsequent to the initial acceleration enrichment transient which terminated at the time $t_2$. This allows the present acceleration enrichment system to more closely monitor engine fuel requirements and provide fuel control in response thereto.

The manner in which the present invention contemplates supplying synchronous acceleration enrichment fuel pulses after the time $t_2$ will now be discussed. Bascially this discussion involves how the present invention provides synchronous acceleration enrichment fuel pulses at the terminal 43 which are selectively passed to the terminal N for combination with the synchronous steady state base fuel control pulses at the terminal M.

The terminal F is directly connected to a set input terminal S of a dual output flip-flop circuit 60 which has its reset terminal R directly connected to the terminal J. A non-inverting output terminal Q of the dual output flip-flop 60 is directly connected to a control terminal of a series pass gate 61 connected between ground potential and the terminal 48. An inverting output terminal $\overline{Q}$ of the dual output flip-flop 60 is directly connected to a control terminal of the series pass gate 47 previously recited as being connected between the terminal 48 and the terminal I'. The terminal 48 is connected as an input to an amplifier and offset circuit 62 which has its output directly connected as an input to an amplitude signal multiplier circuit 63 that provides an output to a terminal 64. The terminal 64 is connected as in input to a voltage to pulse width converter circuit 65 that provides pulses having voltage dependent pulse widths as an output to the terminal 43 when the converter 65 is enabled. A negative transition enable terminal 66 of the converter 65 is directly connected to the terminal M at which the synchronous steady state base fuel control pulses are provided. The terminal 17A at which an analog voltage related to sensed engine air temperature is provided is directly connected as an input to an amplifier 67 that provides an output at a terminal 68 which is connected as an input to the amplitude signal multiplier circuit 63. The operation of the components previously recited in this paragraph will now be described.

Essentially, the signal at the terminal F results in setting the dual output flip-flop 60 such that the gate 61 couples ground to the terminal 48 which is open circuited from the terminal I' by gate 47. Applying a ground signal to the terminal 48 results in the amplifier and offset circuit 62 providing merely a fixed magnitude offset signal as one input to the amplitude signal multiplier circuit 63. The other input to the multipiier circuit 63 is provided by a signal at the terminal 68 related to the sensed engine air temperature. This results in the magnitude of the voltage at the terminal 64 being related to the product of both the fixed offset from the circuit 62 and the sensed engine air temperature. The voltage at the terminal 64 is utilized to determine the duration of the pulse provided by the converter 65. Signal multiplier circuits such as circuit 63 are well known.

The converter 65 is essentially a controllable duration monostable circuit whose pulse widths are related to the voltage provided at the terminal 64 and wherein the occurrence of these pulses is timed to the occurrence of negative transitions at the terminal 66. Since the signal at the terminal 66 corresponds to the steady state base synchronous fuel control pulses provided at the terminal M, the pulses at the terminal 43 are provided at the trailing edge of each of the base control pulses of the signal M. The gate 42, which is enabled during the additional (decay) synchronous acceleration enrichment mode, then passes these pulses which occur between the times $t_2$ and $t_4$ in FIG. 2 and between the times $t_2$ and $t_8$ in FIG. 3 since these time intervals correspond to the times at which the signal G enables the gate 42.

The above described circuit configuration results in the present invention providing fixed duration additional synchronous acceleration enrichment pulses to the terminal N as long as the synchronous acceleration enrichment mode is enabled by the signal G and as long as the sensed rate of change of engine manifold pressure has not decreased beyond the low threshold corresponding to the voltage $V_2$. If synchronous acceleration enrichment pulses are to be provided after the time $t_3$, but the rate of decrease of engine manifold pressure has exceeded the low threshold $V_2$, then a reset signal is provided at the terminal J at the time $t_p$ resulting in resetting the dual output flip-flop 60. This results in opening the gate 61 and closing the gate 47 such that the signal at the terminal 48 is now a direct function of the negative rate of change signal I' of the engine manifold pressure. This results in having the amplifier and offset circuit 62 provide an input to the amplitude signal multiplier circuit 63 that is a function of the negative rate of change of the engine manifold pressure wherein this rate of change exists after the time $t_2$ during the decay portion of the acceleration enrichment transient. The result of this is that the durations of the synchronous acceleration enrichment pulses provided at the terminal 43 are now a function of the rate of decrease of engine manifold pressure as well as being a function of sensed air temperature. Because of this the present invention represents an improvement over prior art systems since only the present invenion contemplates monitoring an engine operational parameter (the rate of decrease of engine manifold pressure) after the initial acceleration transient and determining the amount of acceleration enrichment during this decay portion of the acceleration enrichment cycle in accordance with this sensed engine operational parameter. This is evidenced by the fact that the signal N in FIG. 2 is illustrated as comprising pulses having variable durations determined in accordance with the magnitude of the signal I'.

In addition to determining the duration of the synchronous acceleration enrichment pulses in accordance with a sensed engine operational parameter that exists during the decay portion of the acceleration enrichment cycle, it should also be noted that this is accomplished in addition to the present invention terminating the acceleration enrichment transient mode in response to sensing either a large negative rate of change in the engine manifold pressure which occurs during the decay portion or sensing a lack of further decrease of the sensed engine manifold pressure after an initial decrease of pressure was detected during the decay portion. These latter two features are implemented by the high and low threshold comparators 46 and 45 of the present invention. These methods of terminating the acceleration enrichment transient are in direct contrast to prior art circuits which either terminate acceleration enrichment transients after a fixed period of time or after a predetermined number of engine revolutions, neither of which bears a direct relationship to the engine manifold pressure or its rate of change that exists during the decay portion of the acceleration enrichment transient.

Figure 4C:
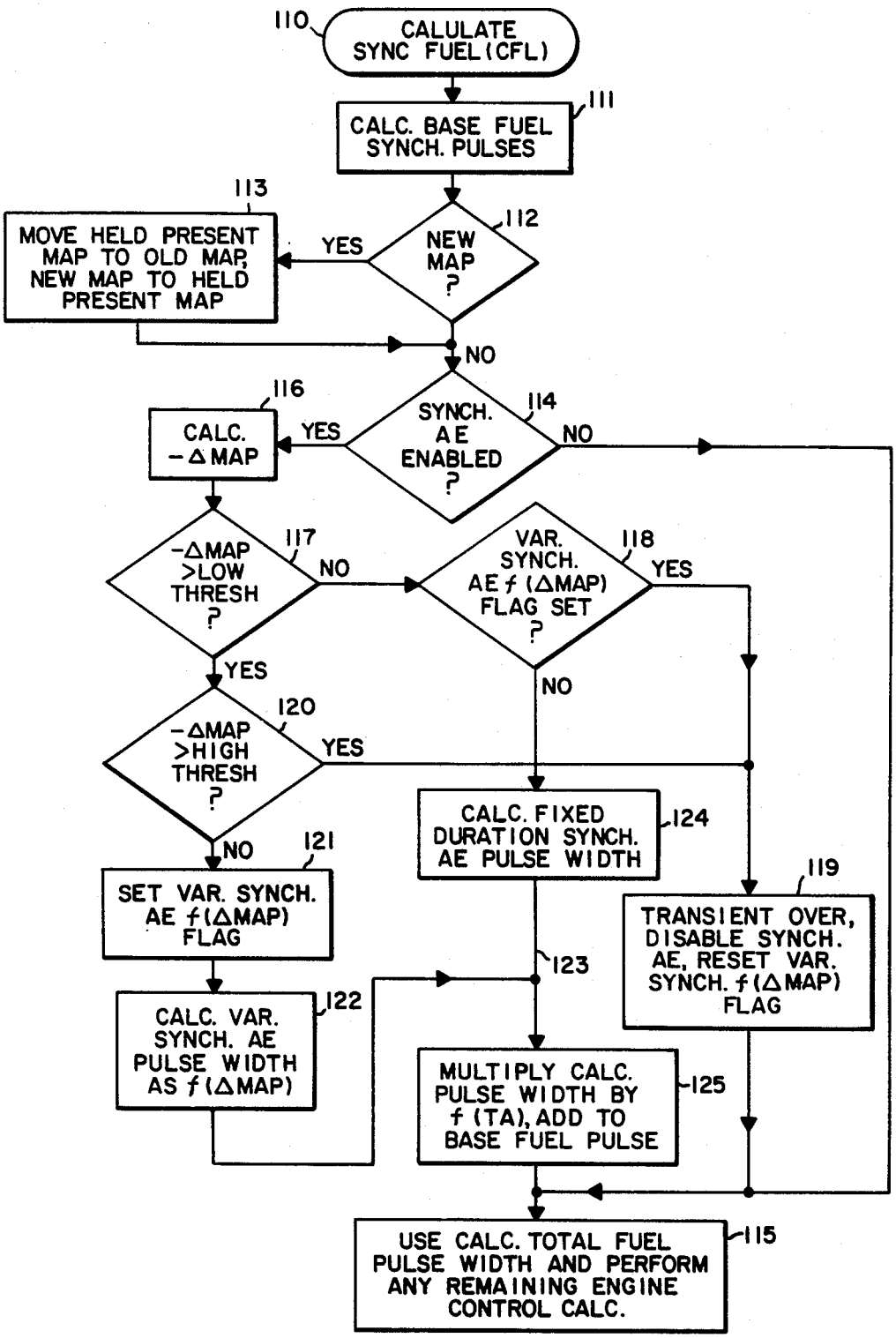
FIG. 4 comprises a series of flowcharts 4A–4D for programming a microprocessor to implement the acceleration enrichment control functions of the present invention which are accomplished by the system shown in FIG. 1.

Preferrably the present invention is implemented by additional programming of the microprocessor 11. FIG. 1 represents a hardware embodiment of the present invention whereas FIG. 4 represents a series of flowcharts which can be utilized to program a microprocessor to accomplish the same end results obtained by FIG. 1. The flowcharts in FIG. 4 also generally describe the operation of the hardware embodiment shown in FIG. 1. The process steps performed by the flowcharts in FIG. 4 will now be discussed. In FIG. 4, process flows designated by dashed rather than solid lines indicate that other nonillustrated process steps may exist in the dashed process flows.

Flowchart A in FIG. 4 represents a general microprocessor software program which initially starts by having the microprocessor accomplish some foreground calculations dealing with either the calculation of fuel or the control of spark timing or other engine functions. This is generally indicated by an initializing block 100. The process flow then eventually proceeds to a decision block 101 that determines if it is necessary for the microprocessor to calculate asynchronous acceleration enrichment. If so, a subroutine CAE, standing for calculate acceleration enrichment, is entered wherein this subroutine is illustrated in detail in flowchart B. After the subroutine, a return to the initializing block 100 is implemented and again control passes to the decision block 101. However this time it is contemplated that control will pass through the decision block 101 to a further decision block 102 since execution of the subroutine CAE will set a flag indicating that further asynchronous acceleration enrichment calculation is not required until the previous CAE caculations are utilized. The subroutine CFL represents calculation of synchronous fuel and is illustrated in flowchart C.

The decision block 102 inquires if a synchronous fuel calculation is required at the present time. If so, the subroutine CFL shown in flowchart C is executed and control again passes to the initializing block 100. If not, the decision block 102 passes control in a different direction and synchronous fuel injection is implemented in accordance with the microprocessor calculated fuel control signals.

Essentially, the decision block 101 determines if asynchronous acceleration enrichment has to be calculated by looking at the rate of change of throttle position which would correspond to looking at whether a high or low logic signal had been provided at the terminal C in FIG. 1 indicating that acceleration enrichment was required during the initial portion of the acceleration enrichment transient.

The decision block 102 essentially corresponds to determining if the timing of the engine rotation is such that it is necessary, at this time, to calculate synchronous fuel control and synchronous acceleration enrichment fuel control pulses. These are the pulses calculated by the CFL subroutine.

The CAE subroutine is illustrated in flowchart B in FIG. 4 and illustrates how asynchronous acceleration enrichment pulses are provided by the microprocessor. The CAE subroutine is entered at an initializing block 103. Control then passes to a process block 104 which calculates the desired asynchronous pulse widths as a function of the rate of change of throttle position. This corresponds to the pulse width modulator circuit 22 in FIG. 4 providing variable pulse durations related to the magnitude of the rate of increase of throttle position which is represented by the magnitude of the signal B. From the process block 104 a process block 105 is encountered which results in providing the output asynchronous acceleration enrichment pulses to the fuel injectors 28. This is accomplished by the AND gate 26, when it is enabled, and the OR gate 29 in the hardware embodiment in FIG. 1. From the process block 105 control is returned to the general microprocessor program shown in flowchart A.

Before discussing the calculate fuel subroutine CFL illustrated in flowchart C, the microprocessor interrupt program shown in flowchart D will be discussed. This interrupt program essentially interrupts the operation of the microprocessor to provide for either enabling the asynchronous or synchronous enrichment modes of operation.

The interrupt routine shown in flowchart D is entered at an initializing block 106 entitled "Throttle Rate Comparator Output Interrupt". Essentially the block 106 corresponds to circuitry for interrupting the operation of the microprocessor in response to either rising or falling transitions of a throttle rate comparator corresponding to comparator circuit 21 in FIG. 1. In response to the occurrence of a positive or negative throttle rate comparator transition, the microprocessor operations are interrupted and process flow passes to a decision block 107 which determines if the output of the throttle rate comparator is high or low after the occurrence of the throttle rate transition which resulted in the entering the interrupt routine. If a high output of the throttle rate comparator is determined, this results in process flow proceeding to a process block 108 that enables the development of asynchronous acceleration enrichment fuel control pulses. If a low throttle rate comparator output is determined by the decision block 107, then process flow passes to a process block 109 which terminates any prior development of asynchronous acceleration enrichment pulses and enables the providing of synchronous acceleration enrichment pulses. After each of the process blocks 108 and 109, process contol is returned to the main microprocessor program.

Essentially, the process block 108 corresponds to the signal C in FIG. 1 resulting in enabling the AND gate 26 to pass asynchronous acceleration enrichment pulses at the terminal D to the engine fuel injectors 28. The process block 109 corresponds to having the signal at the terminal C cause the AND gate 26 to block the passage of further asynchronous acceleration enrichment pulses but having the negative transition of the signal C set the flip-flop 40 which thereby enables the production of synchronous acceleration enrichment pulses by allowing the gate 42 to pass synchronous acceleration enrichment pulses to the terminal N and then eventually to the fuel injectors 28.

The synchronous fuel calculation subroutine CFL in flowchart C is entered at an initializing block 110. Process flow then proceeds to a process block 111 which results in the calculation of the base fuel synchronous control pulses. This is accomplished by the engine control microprocessor 11 in FIG. 1 providing the steady state base fuel control pulses at the terminal M. As was previously noted, several prior fuel control systems describe such microprocessor control of the base fuel control signal.

After the process block 111, control passes to a decision block 112 which determines if the engine manifold air pressure (MAP) signal has changed. If so, control passes to a process block 113 which essentially stores the new MAP signal as a held present MAP signal, and stores the previous held present MAP signal as a held old MAP signal. Control then passes to a decision block 114. If the new MAP signal was not different from the held present MAP signal, then control from the decision block 112 directly passes to the decision block 114.

The decision block 114 determines if synchronous acceleration enrichment has been enabled by the interrupt routine in flowchart D. If not, control then directly passes to a process block 115 which uses the calculated synchronous fuel signals and performs any remaining fuel control calculations. This is because unless the synchronous acceleration enrichment mode has been enabled, then the only synchronous fuel control pulses to be provided by the CFL subroutine are the steady state base fuel control pulses previously calculated by the process block 111.

If the decision block 114 determines that the synchronous acceleration enrichment mode has been enabled, and this is essentially determined by monitoring whether the process block 109 in the interrupt routine in flowchart D has been executed, then process control passes to a process block 116 which calculates the negative rate of change of the manifold pressure (MAP) signal by comparing the held present manifold pressure to the held old manifold pressure. This essentially corresponds to the operation of the signal summer 33 in FIG. 1 which provides a negative rate of change of engine manifold pressure signal at the terminal I which is also essentially provided at the terminal I'. It should be noted that the rate of change of MAP is calculated by determining the actual change in MAP over a predetermined time interval.

From the process block 116, control passes to a decision block 117 that determines if the calculated rate of change in the manifold pressure signal exceeds a low threshold value corresponding to $V_2$ in FIG. 1. If it does not control passes to a process block 118 that determines if the acceleration enrichment (AE) decay is active by checking if a variable synchronous AE flag has been set which indicates that the durations of the synchronous acceleration enrichment pulses should be variable and a function of the rate of change of MAP signal. This corresponds to determining if the flip-flop 60 in FIG. 1 has been reset by the magnitude of the rate of change of manifold pressure signal (I') having previously exceeded the low threshold limit $V_2$ of the low threshold comparator 45. In other words the decision block 118 tests whether a rate of decrease of engine manifold pressure, during the enablement of the synchronous (decay) acceleration enrichment mode, which rate is currently less than $V_2$, has previously exceeded the rate corresponding to $V_2$. If so, process flow proceeds to a decision block 119 that recognizes the end of the acceleration enrichment transient, disables the synchronous acceleration enrichment mode and effectively resets the variable synchronous AE flag. This corresponds to the hardware embodiment in FIG. 1 requiring a negative transition at the terminal J, after a positive transition thereat, to result in the monostable 50 providing an acceleration enrichment termination signal at the terminal L.

If the decision block 117 determines that the effective negative rate of change of MAP currently exceeds the low threshold $V_2$ then control passes to a decision block 120 which determines if the negative rate of change manifold pressure exceeds a high threshold corresponding to the threshold value $V_3$. If so this results in control passing to the process block 119 for implementing termination of the synchronous (decay) acceleration enrichment mode. If the decison block 120 determines that while the present negative rate of change of the manifold pressure exceeds the low threshold $V_2$ it does not exceed the high threshold $V_3$, then control passes to a process block 121 which sets the variable synchronous acceleration enrichment flag. Then control passes to a process block 122 that calculates synchronous acceleration enrichment variable pulse widths in accordance with the current magnitude of the negative rate of change of MAP. This essentially corresponds in the hardware embodiment in FIG. 1 to the resetting of the dual output flip-flop 60 and the closing of gate 47 and opening gate 61. Control then passes to a terminal 123.

It should be noted that if the decision block 117 determines that the magnitude of the present negative rate of change of pressure does not exceed the low threshold limit corresponding to $V_2$, and if the decision block 118 then determines that the variable synchronous AE flag is not set (corresponding to the dual output flip-flop 60 being set), then control passes to a fixed synchronous acceleration enrichment pulse width process block 124. This corresponds to the opening of gate 47 and the closing of gate 61 providing a fixed voltage (ground) at terminal 48 for use in calculating synchronous acceleration enrichment pulse widths. Control passes from both of the process blocks 122 and 124 to the terminal 123 and then to a further process block 125 which results in effectively multiplying either the fixed or variable calculated pulse widths by a factor related to the engne air temperature. This corresponds to the amplitude signal mutiplier 63 taking into account the engine air temperature by multiplying a magnitude related to engine air temperature with the output of the amplifier and offset circuit 62 to determine the pulse width control voltage at the terminal 64 which is used to control the synchronous acceleration enrichment pulse durations provided by the converter 65. After the process block 128 control then passes to the final process block 115 wherein any remaining engine control calculations are performed and wherein the synchronous base and synchronous enrichment pulses are combined and passed to the injectors.

It should be noted that preferrably the present invention is implemented by programming of a microprocessor. The flowcharts A–D in FIG. 4 form the basis of the source code program which can be utilized for programming a microprocessor to implement the basic functions of the present invention. These functions are also implemented by the hardware embodiment of the present invention shown in FIG. 1. In both instances, the present invention has provided an improved acceleration enrichment system in which acceleration enrichment is controlled more in accordance with engine operational parameters than previous acceleration enrichment systems. This results in the present invention responding more closely to actual engine fuel requirements and thereby providing an improved response to engine acceleration.

While we have shown and described specific embodiments of this invention, further modifications and improvements will occur to those skilled in the art. Also such modifications which retain the basic underlying principles disclosed and claimed herein are within the scope of this invention.

What is claimed is:

1. An acceleration fuel enrichment system for an engine, comprising:

sensor means for providing electrical signals representative of a number of sensed engine operational parameters including engine crankshaft rotational position, engine throttle position and engine manifold pressure;

steady state fuel pulse control means coupled to said sensor means for providing base vuel injection pulses synchronized with engine cylinder piston position, the duration of these base fuel injection pulses being determined in accordance with at least one of the sensed engine operational parameters;

wherein the improvement comprises an improved acceleration enrichment means coupled to said sensor means, comprising the combination of;

means for developing at least one initial acceleration enrichment pulse, in addition to said synchronous base fuel injection pulses, in response to an increase in at least any selected one of the sensed engine parameters of engine throttle position and engine manifold pressure causing its rate of change to exceed a predetermined minimum threshold value, means for terminating the development of said at least one initial enrichment pulse, means for effectively providing, at least after termination of said at least one initial enrichment pulse, additional fuel enrichment pulses, said additional pulses having durations determined in accordance with a decreasing rate of change of sensed engine manifold pressure which exists after said selected engine parameter has ceased to increase and after a subsequent decrease in engine manifold pressure has been sensed, means for terminating the providing of said additional fuel enrichment pulses, and combiner means for effectively adding said at least one initial and additional fuel enrichment pulses to said synchronous base fuel pulses thereby providing a composite engine fuel control signal.

2. An acceleration fuel enrichment system for an engine, comprising:

sensor means for providing electrical signals representative of a number of sensed engine operational parameters including engine crankshaft rotational position, engine throttle position and engine manifold pressure;

steady state fuel pulse control means coupled to said sensor means for providing base fuel injection pulses synchronized with engine cylinder piston position, the duration of these base fuel injection pulses being determined in accordance with at least one of the sensed engine operational parameters;

wherein the improvement comprises an improved acceleration enrichment means coupled to said sensor means, comprising the combination of;

means for developing initial asynchronous acceleration enrichment pulses, in addition to said synchronous base fuel injection pulses, in response to an increase in at least any selected one of the sensed engine parameters of engine throttle position and engine manifold pressure causing its rate of change to exceed a predetermined minimum threshold value, means for terminating the development of said initial asynchronous enrichment pulses, means for effectively providing, at least after termination of said initial asynchronous enrichment pulses, additional fuel enrichment pulses synchronous with said base fuel pulses, said additional pulses having durations determined in accordance with a decreasing rate of change of sensed engine manifold pressure which exists after said selected engine parameter has ceased to increase and after a subsequent decrease in engine manifold pressure has been sensed, means for terminating the providing of said additional fuel enrichment pulses, and combiner means for effectively adding said asynchronous fuel enrichment pulses and said additional synchronous enrichment pulses to said synchronous base fuel pulses and thereby providing a composite engine fuel control signal.

3. An acceleration fuel enrichment system according to claim 2 wherein said means for terminating said additional synchronous fuel pules includes first comparator means for terminating said additional synchronous fuel pulses in response to sensed engine manifold pressure decreasing over a predetermined time interval by more than a predetermined high threshold value, whereby this large decrease in manifold presure is utilized to indicate the end of an engine acceleration transient.

4. An acceleration fuel enrichment system according to claim 2 wherein said means for terminating said additional synchronous fuel pulses includes second comparator means for terminating said additional synchronous fuel pulses in response to sensed engine manifold pressure decreasing over a predetermined time interval by less than a predetermined low threshold value after said asynchronous enrichment pulses were terminated, and after a decrease of sensed pressure over a predetermined time interval during the developing of said additional sychronous enrichment pulses exceeded said low threshold value.

5. An acceleration fuel enrichment system according to claim 3 wherein said means for terminating said additional synchronous fuel pulses includes second comparator means for terminating said additional synchronous fuel pulses in response to sensed engine manifold pressure decreasing over a predetermined time interval by less than a predetermined low threshold value after said asynchronous enrichment pulses were terminated, and after a decrease of sensed pressure over a predetermined time interval during the developing of said additional enrichment pulses exceeded said low threshold value.

6. An acceleration fuel enrichment system according to claim 5 wherein said predetermined time intervals utilized by said first and second comparator means are determined in accordance with pulses corresponding to sensed engine rotational positions.

7. An acceleration fuel enrichment system according to any of claims 2, 3 or 4 wherein said means for terminating said initial asynchronous enrichment pulses includes comparison means for terminating said asynchronous pulses in response to the rate of change of a sensed engine parameter exceeding a threshold value.

8. An acceleration fuel enrichment system according to claim 2 wherein said means for providing said additional synchronous fuel enrichment pulses comprises means for initially providing as said additional synchronous fuel pulses, after termination of said asynchronous fuel pulses, fixed duration pulses, having durations independent of sensed engine manifold pressure, followed by variable duration pulses having durations related to sensed engine manifold pressure which exists after said selected engine parameter has ceased to increase.

9. An acceleration fuel enrichment system according to claim 8 wherein said variable duration pulses are provided after and in response to said sensed engine manifold pressure decreasing over a predetermined time interval by more than a low threshold value.

10. An acceleration fuel enrichment system for an engine, comprising:

sensor means for providing electrical signals representative of a number of sensed engine operational parameters including engine crankshaft rotational position, engine throttle position and engine manifold pressure;

steady state fuel pulse control means coupled to said sensor means for providing base fuel injection pulses synchronized with engine cylinder piston position, the duration of these base fuel injection pulses being determined in accordance with at least one of the sensed engine operational parameters;

wherein the improvement comprises an improved acceleration enrichment means coupled to said sensor means, comprising the combination of;

means for developing acceleration enrichment pulses, in addition to said base fuel synchronous injection pulses, in response to an increase in at least any selected one of the sensed engine parameters of engine throttle position and engine manifold pressure causing its rate of change to exceed a predetermined minimum threshold value, combiner means for effectively adding said fuel enrichment pulses to said synchronous base fuel pulses and thereby providing a composite engine fuel control signal, and means for terminating the development of said enrichment pulses in response to a sensed engine condition parameter falling below a predetermined threshold value, wherein said means for terminating said fuel enrichment pulses comprises means for terminating said fuel enrichment pulses in response to sensed engine manifold pressure decreasing over a predetermined time interval by more than a predetermined high threshold value, whereby this large decrease in manifold presure is utilized to indicate the end of an engine acceleration transient.

11. An acceleration fuel enrichment system for an engine, comprising:

sensor means for providing electrical signals representative of a number of sensed engine operational parameters including engine crankshaft rotational position, engine throttle position and engine manifold pressure;

steady state fuel pulse control means coupled to said sensor means for providing base fuel injection pulses synchronized with engine cylinder position, the duration of these base fuel injection pulses being determined in accordance with at least one of the sensed engine operational parameters;

wherein the improvement comprises an improved acceleration enrichment means coupled to said sensor means, comprising the combination of;

means for developing acceleration enrichment pulses, in addition to said base fuel synchronous injection pulses, in response to an increase in at least any selected one of the sensed engine parameters of engine throttle position and engine manifold pressure causing its rate of change to exceed a predetermined minimum threshold value, combiner means for effectively adding said fuel enrichment pulses to said synchronous base fuel pulses and thereby providing a composite engine fuel control signal, and means for terminating the development of said enrichment pulses in response to a sensed engine condition parameter falling below a predetermined threshold value, wherein said means for terminating said fuel enrichment pulses comprises means for terminating said fuel enrichment pulses in response to sensed engine manifold pressure decreasing over a predetermined time interval by less than a predetermined low threshold value after a decrease of sensed pressure over a predetermined time interval during the developing of said enrichment pulses exceeded said low threshold value.

12. An acceleration fuel enrichment according to claim 11 wherein said means for terminating said fuel enrichment pulses also comprises means for terminating said fuel enrichment pulses in response to sensed engine manifold pressure decreasing over a predetemined time interval by more than a predetermined high threshold value greater than said low threshold value, whereby this large decrease in manifold pressure is utilized to indicate the end of an engine acceleration transient.

* * * * *